US006343776B1

(12) United States Patent
Coon

(10) Patent No.: US 6,343,776 B1
(45) Date of Patent: Feb. 5, 2002

(54) SIGN HANGING DEVICE

(76) Inventor: Gary T. Coon, 113 Tinker Pl., Troutman, NC (US) 28166

( * ) Notice: Subject to any disclaimer, the term of this patent is extended or adjusted under 35 U.S.C. 154(b) by 0 days.

(21) Appl. No.: 08/997,770

(22) Filed: Dec. 24, 1997

(51) Int. Cl.[7] ..... A47H 1/10
(52) U.S. Cl. ..... 248/317; 248/339
(58) Field of Search ..... 248/317, 339, 248/218.4; 40/607, 591, 617

(56) References Cited

U.S. PATENT DOCUMENTS 1,095,739 A * 5/1914 Schramm ..... 40/617 X
1,845,032 A * 2/1932 Baum ..... 40/617
1,866,530 A * 7/1932 Funk ..... 40/617
2,004,819 A * 6/1935 Martin ..... 40/617
2,052,771 A * 9/1936 Johnson ..... 40/617
2,689,104 A * 9/1954 Pfaff, Jr. ..... 248/317 X
2,926,442 A * 3/1960 Reimel ..... 40/617 X
4,250,647 A * 2/1981 Woodard ..... 40/617
4,884,351 A * 12/1989 Abramson ..... 40/617 X
5,174,536 A * 12/1992 Pelletier et al. ..... 248/339

* cited by examiner

*Primary Examiner*—Leslie A. Braun
*Assistant Examiner*—Korie H. Chan

(57) ABSTRACT

A metal angle iron bar 4, with a flatbar 2 welded to the angle iron bar 4 at point 3 on the top leg 10. The flatbar 2 having a metal dowel 1 welded to the end opposite of point 3. A pad 8 is attached to the end of the angle iron bar 4 and two cylindrical holes are drilled in the downturn leg 9 of the angle iron bar 4 to accommodate two "S" hooks. The outside downturn leg 14 provides additional support and stress accommodation to the end plate 5 and top leg 10.

5 Claims, 4 Drawing Sheets

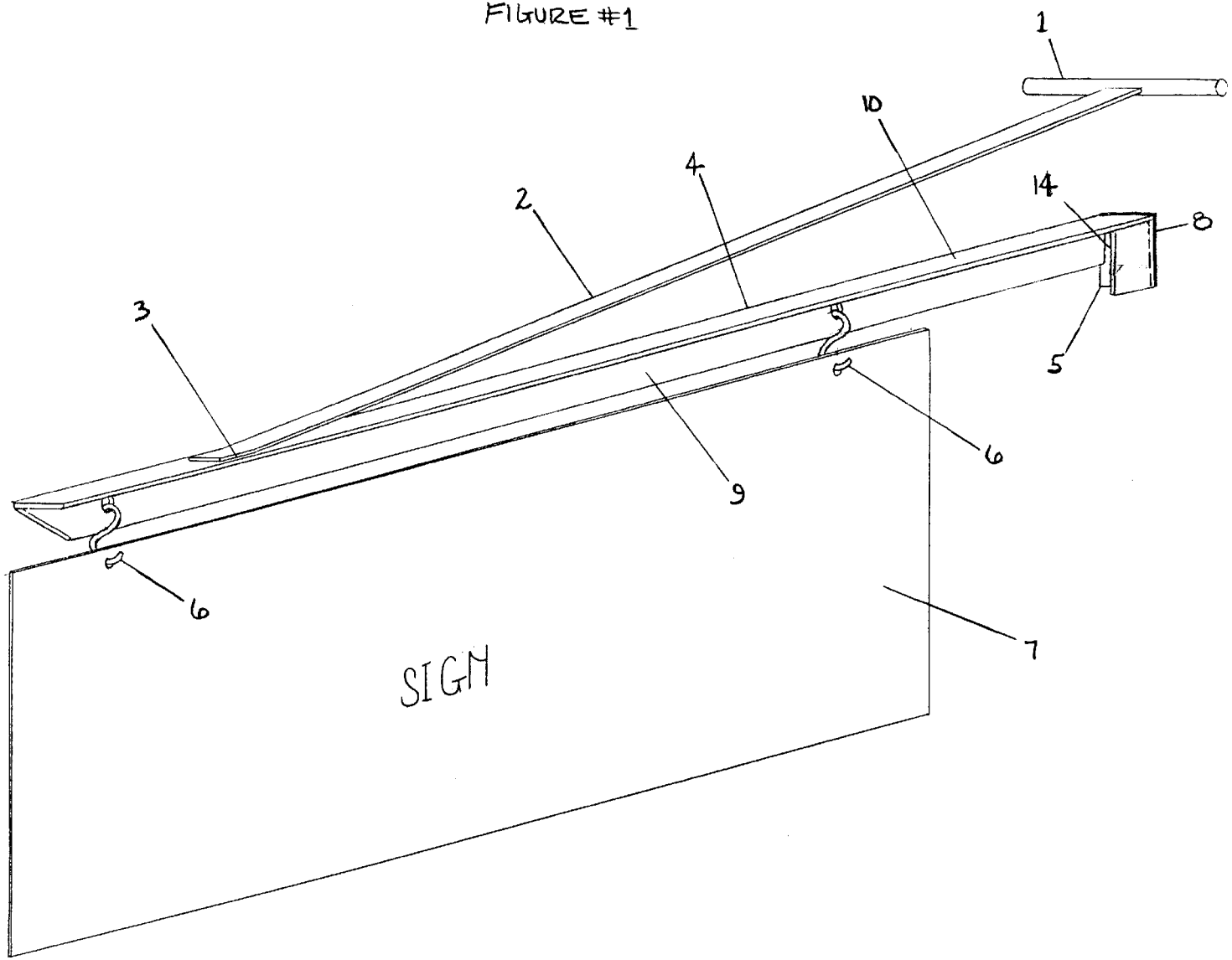
FIGURE #1

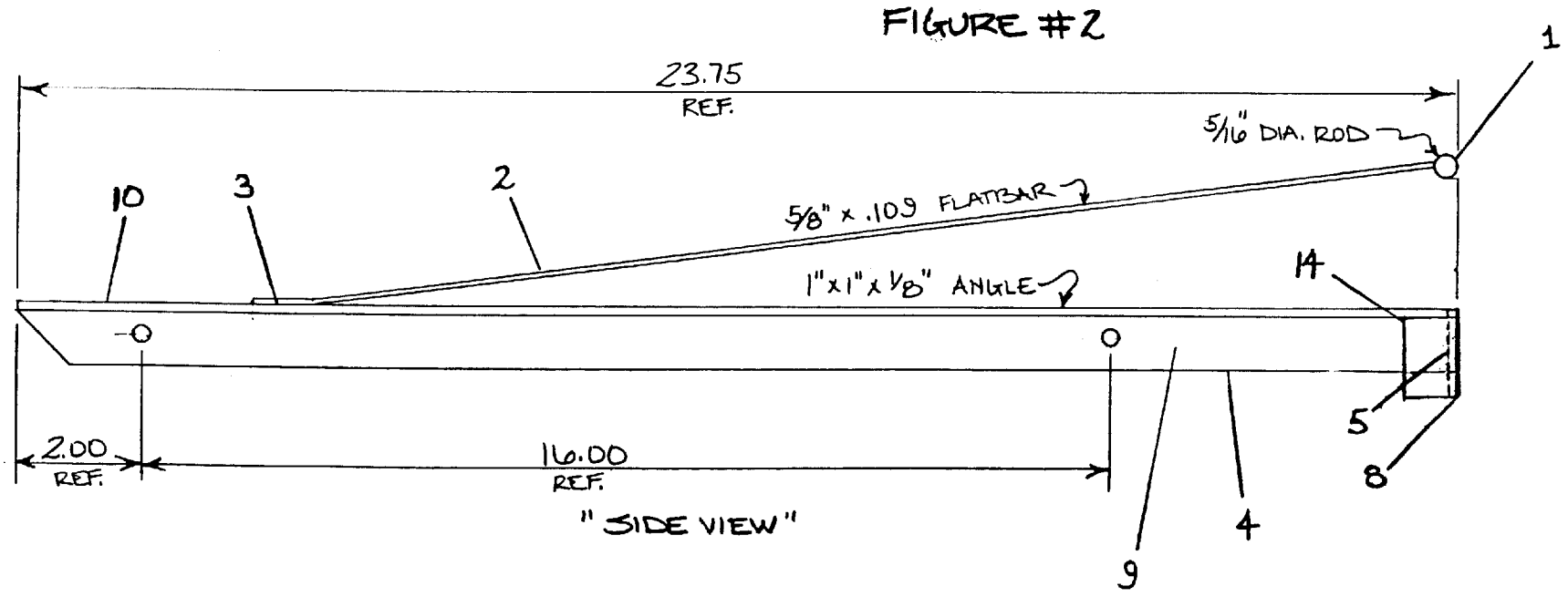
FIGURE #2

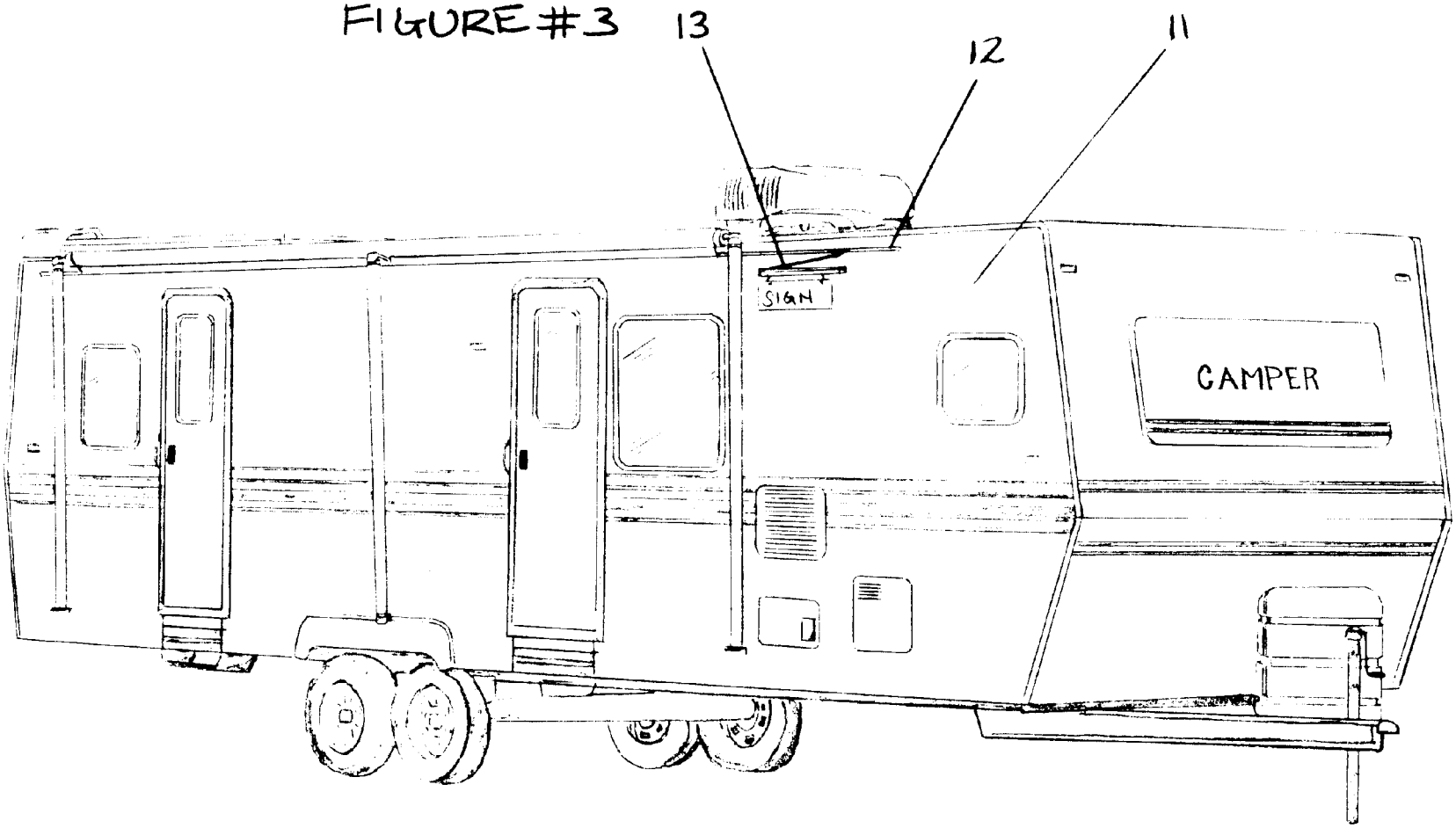
FIGURE #3

FIGURE # 4
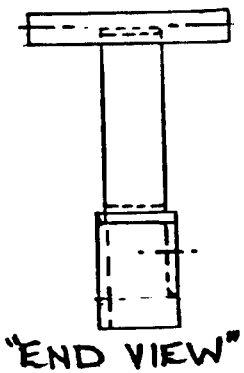

SIGN HANGING DEVICE

BACKGROUND—FIELD OF INVENTION

This invention is designed to support a hanging sign. It is affixed perpendicularly to the side of a recreational vehicle, or outside wall of a building or edifice, by way of a mounting rail. It will provide stable support from which the sign may be displayed.

BACKGROUND—DESCRIPTION OF PRIOR ART

Attaching a horizontal sign to a vertical edifice is often cumbersome and difficult. It typically involves the application of a bulky bracket with many screws and anchoring supports to be affixed to the wall. The corresponding device, fitted to the bracket, is usually comprised of multiple parts which interlock and connect with the bracket at many different stress points to accommodate the weight to the sign. The use of multiple parts increases the likelihood of failure for one of the individual components and hence the degradation and eventual failure of the entire support mechanism. Additionally, the use of multiple parts make the assembly and installation process more difficult and increase the likelihood of one of the parts being damages or lost. Heretofore, many different arrangements were used to alleviate the impediments of installing a horizontal sign to a vertical edifice. The following is a discussion of these arrangements and their drawbacks to installation.

One arrangement involves mounting a rectangular sign assembly directly against a wall. Taylor U.S. Pat. No. 4,268,984 (1979) is exemplary. However, in this arrangement, the sign can only be suspended vertically from the wall. Thus, it can not be viewed from a right-angle to the wall.

Another arrangement, shown in Soporowski U.S. Pat. No. 4,698,928 (1985) is also mounted directly against the wall. It utilizes a dual-rail system to slide the sign into the bracketing system. It has the same viewing drawbacks as the Taylor patent and the sliding process, upon insertion and removal, is subject to bending or breaking the rails on both the bracket and sign.

U.S. Pat. No. 5,335,889 to Hopkins and Hall, demonstrates a bracket assembly for mounting a horizontal sign. It uses a multiple-point attachment system and needs a post or pole to support the assembly. An L-shaped bracket extends horizontally from the mounting bracket and the sign is fitted. The multiple-point attachment system can not be mounted to a flat surface.

U.S. Pat. No. 4,263,739 to Lee also uses a mounting system for a horizontal sign. The mounting flange of the bracket extends perpendicular from the base and fits between the plates of the display structure.

OBJECTS AND ADVANTAGES

My invention provides several objects and advantages whereby the sign can be mounted upon structures which typically are incapable of supporting a perpendicular sign. This allows the placement of a sign in a new and unique location.

My invention is designed for attachment to any surface which accepts the adhesion of a strip of metal mounting rail. It combines simplicity of design and function as well as being very easy to use by people of all ages. An advantage is the small linear area required for the point of attachment. Many fastening systems necessitate large bulky mechanisms to secure the sign to the structure. A small length of mounting rail is all my invention needs to form a secure point of attachment.

The dowel end, located at the end of the flatbar, simply slides, horizontally, into the mounting rail consuming the entire dowel. This precipitates pressure at the connection point of the flatbar and metal angle iron piece. The generated stress utilizes the weight of the angle iron piece and the attached sign to press the butt end of the hanger against the vertical surface of the wall.

The hanging sign may be vertically adjusted by sliding the butt end up or down to achieve a true horizontal position of the mainframe. If a permanent installation is desired, simply squeeze the end of the mounting rail shut with pliers. Another advantage allows the addition of multiple signs beneath the top sign by linking them together with additional "S" hooks. My invention has two pre-drilled holes on the outer edges of the metal angle iron. "S" hooks are inserted in these holes and the sign, which has corresponding pre-drilled holes, can be attached. Multiple signs can be added in a similar fashion.

Most support assemblies for signs are very complicated and cumbersome. They require a great deal of effort and a reasonable level of expertise to assemble. A major advantage of my invention is the simplicity of assembly. Because it is one piece, the user simply slides the dowel rod into the mounting rail in one fluid motion and it is ready for use. Once the sign is attached to the "S" hooks, simply squeeze the "S" hooks closed. If there is not an existing strip of mounting rail, a small strip (supplied with the invention) can quickly be mounted with two screws.

A further advantage is its versatility and portability. It can be removed in just a few seconds. Additionally, it can be displayed in a small area using a vertical post. Used in this fashion, it is ideal for small advertising displays inside a building where it would heretofore be impossible to hang a sign.

Applications for my invention would include a Recreational Vehicle, private residence, garage, dock, horse trailer, horse barns, and stalls. It could be displayed at retail stores, flea markets, race tracks, amusement parks, and sports stadiums. Because of its versatility, it can be displayed indoors as easily as outdoors. Because the weight is supported horizontally, instead of vertically (the support-from-below method), a free-span area is created in which the sign can hang freely.

BRIEF DESCRIPTION OF THE DRAWINGS

FIG. 1 is a side view of the device

FIG. 2 is a slightly elevated side view of the device.

FIG. 3 is a perspective view of the position of the device mounted upon a recreational vehicle FIG. 4 is an end view of FIG. 1.

SUMMARY

This device consists of a metal angle iron with two predrilled holes at the lower edges of the inside down-turn leg. Welded to the top leg of the angle iron is a metal flatbar with a cylindrical metal dowel welded to its end. At the end-plate of the angle iron, a small square strip of foam pad is affixed to prevent scratching of the surface to which the end-plate is pressed. This pressure point is created by the weight of the device, and attached sign, pulling vertically in conjunction with the end of the welded flatbar. The flatbar is affixed approximately 80% down the length of the angle iron away from the end-plate. The dowel, welded to the opposite end of the flatbar, provides semi-horizontal support for the load bearing angle iron acting as a stabilization matrix. This dowel slides horizontally into a cylindrical strip of metal mounting rail (⅜ inch inside dimension) which is mounted upon the wall of the structure. The interaction of the two pressures points (the angle iron end-plate and conjunction point of the flatbar and top leg of the angle iron) and the cylindrical dowel, inserted in the mounting rail, provides a stable matrix to support the weight of a hanging sign(s).

PREFERRED EMBODIMENT—DESCRIPTION

Operation of the device is simple and straightforward. In FIG. 1, the metal flatbar 2 is welded 3 to the top leg 10 of the metal angle iron 4. At the opposite end, a cylindrical metal dowel 1 is welded to the flatbar 2. This dowel 1 is then inserted into a cylindrical metal mounting rail. The inside downturn leg 9 has two predrilled holes in which "S" hooks are attached and act as natural load-bearing stress points. The end plate 5 has a square strip of adhesive foam pad 8 attached to prevent abrasion to the surface the device is resting against. The smaller outside rectangular downturn leg 14, attached to the end plate 5, provides additional support for the top leg 10 and end plate 5. It is slightly longer vertically than the inside downturn leg 9 and exactly the same vertical length as the end plate 5 and adhesive foam pad 8 attached to the end plate 5.

FIG. 2 demonstrates the functionality of the device by showing a sign 7 attached to the inside downturn leg 9 with "S" hooks 6.

FIG. 3 demonstrates the actual installation of the device 13 to a recreational vehicle 11 by mounting it onto an awning rail 12.

CONCLUSIONS, RAMIFICATIONS AND SCOPE

It can be seen that the device provides a stable and secure method to vertically hang signs to a horizontal edifice. A cylindrical metal dowel is horizontally inserted into a metal mounting rail. Said dowel is welded to a metal flatbar which is welded to a metal angle iron. Said angle iron having two predrilled holes in which metal "S" hooks are attached to interlink with the pre-drilled holes of a sign. The weight of the sign and angle iron are uniformly distributed across the length of the angle iron culminating in a pressure point at the endplate which holds the device securely in place.

Although the description above contains many specificities, these should not be construed as limiting the scope of the invention but as merely providing illustrations of some of the presently preferred embodiments of this invention. Various other embodiments and ramifications are possible within it's scope.

Thus the scope of the invention should be determined by the appended claims and their legal equivalents, rather than by the examples given.

What is claimed is:

1. A sign hanging device, comprising:

an angle bar having a horizontal top leg, an inside vertical leg extending downwardly from a first side thereof, and first and second ends;

a vertical endplate attached to the top leg and vertical leg at said first end of said angle bar;

an outside vertical leg extending downwardly from a second side of said angle bar and attached to said endplate;

at least two cylindrical holes drilled in said inside vertical leg;

a flatbar welded at a first end thereof to said top leg adjacent said second end of said angle bar;

a cylindrical metal dowel welded to a second end of said flatbar; and a square adhesive pad affixed to said endplate.

2. The sign hanging device defined in claim 1 wherein said angle bar, flatbar and dowel are comprised of fiberglass.

3. The sign hanging device defined in claim 1 wherein said angle bar, flatbar and dowel are comprised of plastic.

4. The sign hanging device defined in claim 1 wherein said inside vertical leg includes three said cylindrical holes.

5. The sign hanging device defined in claim 1 wherein said inside vertical leg includes four said cylindrical holes.

* * * * *